US006119614A

United States Patent [19]

Kimura

[11] Patent Number: 6,119,614

[45] Date of Patent: Sep. 19, 2000

[54] WOVEN TAPE AND METHOD FOR SIDE-STITCHING THE SAME

[75] Inventor: Yoshihiro Kimura, Fukui, Japan

[73] Assignee: Nippon Dom Co., Ltd., Japan

[21] Appl. No.: 09/203,279

[22] Filed: Dec. 1, 1998

[30] Foreign Application Priority Data

| | | | |
|---|---|---|---|
| Dec. 1, 1997 | [JP] | Japan | 9-347192 |
| Dec. 26, 1997 | [JP] | Japan | 9-367995 |
| Sep. 28, 1998 | [JP] | Japan | 10-272743 |

[51] Int. Cl.[7] ..... D05B 1/18; D05B 3/20

[52] U.S. Cl. ..... 112/475.26; 112/475.08; 112/162

[58] Field of Search ..... 112/403, 416, 112/425, 426, 441, 152, 162, 93, 95, 83, 470.33, 475.06, 475.08, 475.26, 197, 199, 202, 171; 83/16, 935; 428/102, 130, 224, 225, 288

[56] References Cited

U.S. PATENT DOCUMENTS

| | | | |
|---|---|---|---|
| 1,717,075 | 6/1929 | Theroux | 112/475.26 X |
| 4,563,962 | 1/1986 | Muskulus | 112/475.08 |
| 4,594,955 | 6/1986 | Lichtenberg | 112/129 X |
| 4,696,244 | 9/1987 | Sampson et al. | 112/475.08 |
| 5,189,769 | 3/1993 | Shoesmith | 112/475.06 |
| 5,226,379 | 7/1993 | Everett | 112/475.06 |

FOREIGN PATENT DOCUMENTS

| | | |
|---|---|---|
| 344285 | 3/1959 | Japan . |
| 3045863 | 9/1997 | Japan . |

*Primary Examiner*—Ismael Izaguirre

[57] ABSTRACT

A woven tape or label having fiber molten parts generated on both side edges thereof is provided with a tape body and two lines of chain stitch, each line of the chain stitch having a large number of loops formed with one sewing thread, and thus each of the fiber molten parts is wrapped in the chain stitch of one sewing thread. The chain stitch prevents the fiber molten parts from projecting when the tape or label is bent and sewn on an article of clothing. If desired, the label can contain shrinkable yarns interwoven partially as weft yarns in portion thereof applicable as one or two bent places at sewing.

14 Claims, 6 Drawing Sheets

WOVEN TAPE AND METHOD FOR SIDE-STITCHING THE SAME

BACKGROUND OF THE INVENTION

The present invention relates to a side-stitched tape or label of which one or two fiber molten parts are wrapped with sewing threads, and a method for side-stitching a raw tape to cover closely the fiber molten parts on both side edges thereof correctly.

A polyester woven label for sewing on a commercially available textile article is produced by weaving to form a strip with a narrow loom, and cutting the strip into pieces one by one. The weaving method using the narrow loom is disadvantageous, causing low production efficiency and high production cost. For this reason, at present, there is dominantly employed a method of weaving synthetic fiber yarns into a wide figured cloth with a high speed loom such as a Repier loom and so forth, and cutting the wide figured cloth with a heated cutting means.

When the wide figured cloth is heat cut into strip tapes, weft yarns of the wide figured cloth are melted and cut to form linear fiber molten parts on the both side edges of a formed tape. The fiber molten parts, if the fibers are polyester, present a glassy appearance. The touch and appearance of the fiber molten parts are very incongruous with the whole of the weaving structure. In case of a label formed by cut of the woven tape, the fiber molten parts on the both side edges are broken to form molten projecting pieces when the label is folded to be sewn on clothes. As to the label sewn on clothes, projecting pieces of the molten parts, if, e.g., the clothes are under wear, may contact with the skin of a wearer to itch him uncomfortably, and also may injure his skin. If the clothes are outer wear such as a ski wear and so forth, a sweater and an intermediate shirt under the label may be fluffed or loosened.

As to woven labels formed by heat cut of wide figured cloths, a number of users in the clothing industries, and so forth emphatically demand that such fiber molten parts should be eliminated. As a countermeasure against the fiber molten parts, a method of cutting a wide figured cloth by application of supersonic waves has been proposed. However, though the melting of fibers is inhibited by supersonic wave cutting, there remains a problem that a cut portion of the cloth is liable to loosen. By stitching the both side edges of a woven label with an over-locking machine to wrap a fiber molten part with a sewing thread, projections of the fiber molten parts on the both side edges can be reduced, and incongruity with the overall weaving structure in touch and appearance can be significantly solved. However, in stitching with the over-locking machine, the stitching width on the side edge is increased, and further the stitching portion of the label is upheaved by presence of a sewing thread entangled with woolly yarns. These are unfavorable for sewing on of the woven label and are aesthetically undesirable.

SUMMARY OF THE INVENTION

According to the present invention, there is provided a woven tape having fiber molten parts generated on both side edges thereof by cutting a wide figured cloth with a heated cutting means, which comprises a tape body and two lines of chain stitch extending along both side edges thereof. Each line of the chain stitch comprises a large number of loops formed with one sewing thread penetrating from one side to the other side of the tape and crossing over the side edge of the tape repeatedly so that the loops of the sewing thread are closely arranged side by side, whereby the fiber molten parts are covered with the chain stitch of the sewing thread respectively. Preferably, an inclination of the sewing thread on the each side edge of the woven tape is substantially symmetric with respect to the center line on the plane of the woven tape. The side-stitched tape may be used as a woven ribbon in the strip-shape as it is, or may be cut in the transverse direction for use as a woven label. Preferably, as the sewing thread, a yarn as thin as a weft yarn of a raw tape is used, since the color of the tape as a whole can be harmonized. This tape can be hot pressed in after-finishing to be smoothened, eliminating irregularities in thickness over the tape.

Preferably, the woven label contains a shrinkable yarn interwoven therein as a weft partially in a portion thereof to be folded prior to sewing of the woven label. Preferably, a slight depression is formed in the both side edges of the bend portion by shrinking after weaving. The shrinkable yarns may be contained as wefts in a broad portion of the tape to be folded prior to sewing on, or three to five shrinkable yarns may be incorporated in a bending portion only thereof. The shrinkable yarns may be heat shrinkable or may be water shrinkable yarns or chemical reactive yarns shrinkable by spray of water or a chemical or dipping in water or a chemical.

According to the present invention, a method of side-sewing comprises supplying a raw tape having fiber molten parts in the both side edges thereof in the posture of the raw tape that the transverse direction is kept vertical, and moving forward and backward a sewing thread on and near one side edge of the raw tape, repeatedly, to form a chain stitch extending in the longitudinal direction. In this method, the raw tape after it is chain-stitched on one side edge of the tape may be turned over about the longitudinal axis and chain-stitched on the other side edge thereof. Preferably, when the side edge of the tape is chain-stitched with a machine needle, the machine needle passes under the end of a pressing plate, and a sewing thread of a loop, prevented from contacting directly with the side edge of the raw tape, gets into direct contact with the top face in the pressing plate end. As a result, the sewing thread of the loop is prevented from contacting directly with the side edge of said tape in fastening of the sewing thread when a high tension is applied to the sewing thread, so that the chain stitch having properties without irregularities can be formed, irrespective of the rigidity and thickness of the raw tape. Preferably, the raw tape to be supplied is positioned by a first guide plate to support the upper side edge of the raw tape and a second guide plate to contact with the lower side edge of the raw tape, and the first and second guide plates are vertically adjustable in position.

It is an object of the present invention to provide a woven tape in which a side edge sewing portion is inappreciable, and having an aesthetic appearance and an excellent touch.

It is another object of the present invention to provide a woven label in which a side edge sewing portion is inappreciable, and having an aesthetic appearance and an excellent touch.

It is still another object of the present invention to provide a woven label in which the formation of a projecting piece is prevented when the label is folded at sewing, eliminating unpleasantness from wearing of clothes having such label.

It is still another object of the present invention to provide a method of side-edge sewing by which a woven tape can be side-edge sewn automatically and rapidly to wrap closely a fiber molten part with a sewing thread.

It is still another object of the present invention to provide a method of side-edge sewing by which stretching of a woven tape is prevented in side-edge sewing, and irregularities in chain-stitch wrapping a fiber molten part therein are eliminated, and cutting of fluffing or a sewing thread is prevented.

The above and other objects, features and advantages will be more apparent to those skilled in the art in the following description.

DETAILED DESCRIPTION OF THE INVENTION

The present invention will be now described in reference to embodiments. However, it should be understood that the present invention is not limited to the embodiments, and variations may be made by one skilled in the art without departing from the spirit and scope of the invention.

Figure 1:
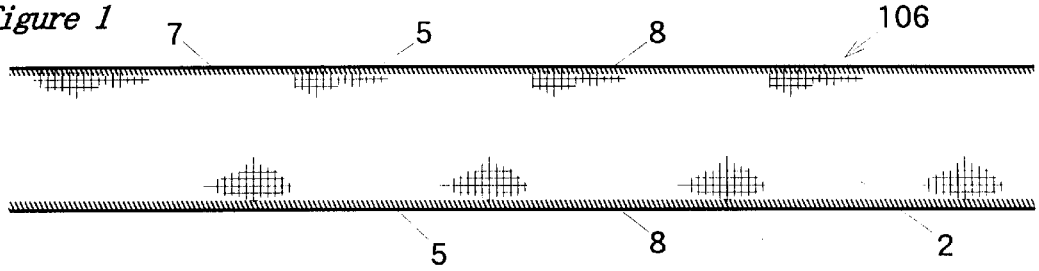
FIG. 1 is a schematic plan view of a woven tape of which the both side edges are sewn in accordance with the present invention.

A raw tape, as shown FIGS. 1 and 2*a*, is produced by cutting a wide figured cloth (FIG. 15) with headed cutting means into a strip shape, as well known. Fiber molten parts (not shown) are formed on the both side edges 5, 5 of the raw tape, caused by the heat cut. The wide figured cloth 3 is produced by weaving polyester yarns, nylon yarns, cotton yarns, and so forth. At least the heat cut portions of the wide figured cloth contains synthetic fiber yarns interwoven with the above yarns therein. According to an aspect of the present invention, a sewing thread 8 is fed forward and backward, near and along the side edge 5, repeatedly to form a chain-stitch extending in the longitudinal direction. As the sewing thread, a thin yarn such as a weft yarn of the raw tape and a thick yarn such as a woolly yarn are available. In general, the sewing thread 7 is formed of a twisted yarn, but a non-twisted yarn may be used. In the case of a woven ribbon, varieties may be rendered in its design by using the sewing threads 7 with different counts and colors.

Figure 7:
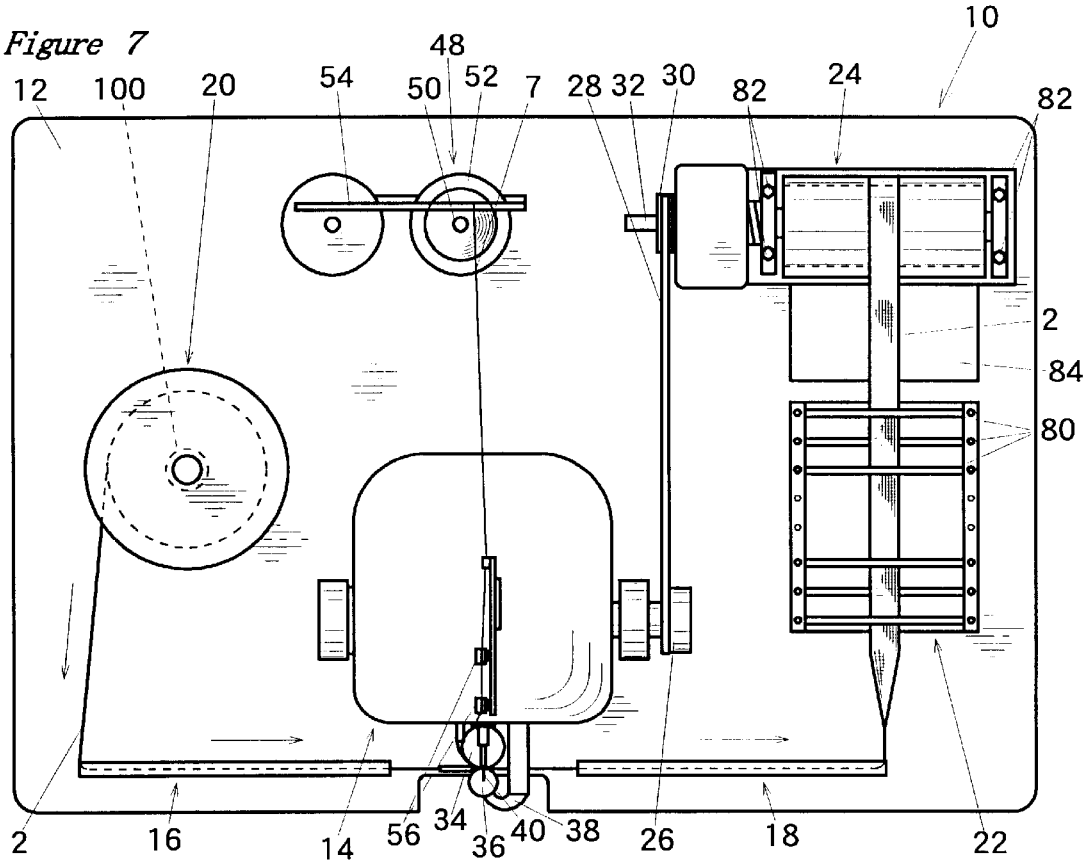
FIG. 7 is a schematic overall plan view of an apparatus for side edge sewing one side edge of a woven tape and then the other side of the woven tape, separately.

As to an apparatus 10 used in accordance with the present invention, all of the component parts of a side sewing assembly 10 are mounted on one rectangular table 12 as shown in FIG. 7. The table 12 is movable with castors (not shown) equipped beneath the table 12. A well-known side sewing machine 14 is installed in the front, center of the table 12. First and second guides 16, 18 are vertically fixed, e.g., screwed in the front, opposite sides of the table 12. The both guides 16, 18 are aligned with each other, substantially in parallel to the front of the machine 14. A tape spool stand 20 having a spool pin and a spool pin washer is vertically attached on the back side of the first guide 16. A horizontal guide 22 is positioned on the back side of the second guide 18. A pair of upper/lower rollers 24 are rotatably disposed in the right-hand side of the table 12, on the back side of the horizontal guide 22.

Figure 10:
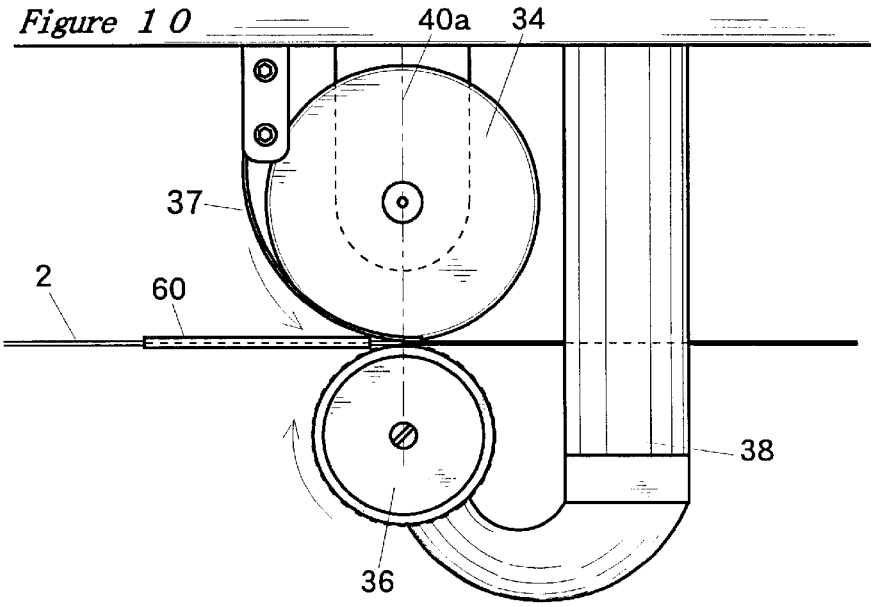
FIG. 10 is a partial plan view of substantially the same portion as in FIG. 9, in which a pressing plate is added and elementary portions are shown at a different magnification.
Figure 11:
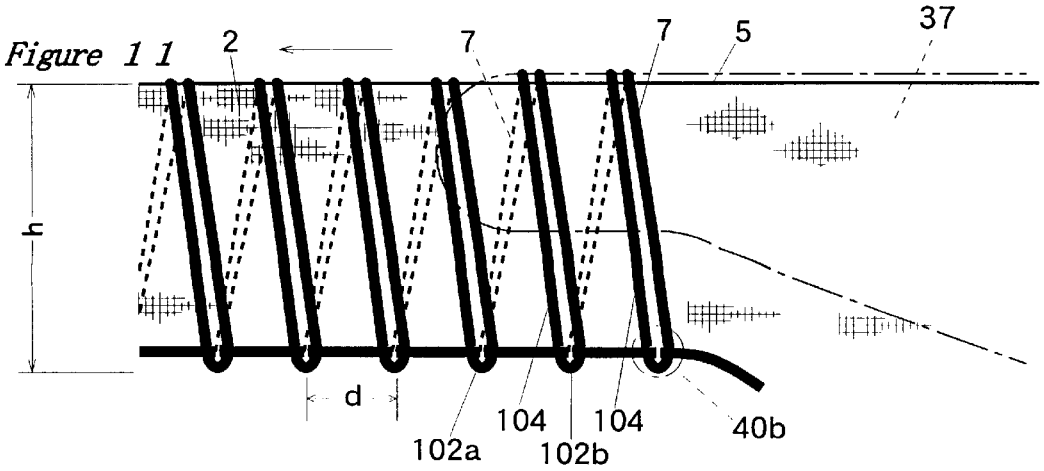
FIG. 11 is an enlarged side view illustrating a stitched side edge of a woven tape from the back of the tape, in which the side-stitching state is deformed for easy understanding.

The side sewing machine 14 is driven with a microcomputer-controlled torque motor (not shown) securely fixed to the underside of the table 12. The torque motor rotates a rotary shaft 32 of a pair of the rollers 24, 24 through a pulley 26 secured to the rotary shaft of the machine, a belt 28, and a pulley 30 secured to the rotary shaft 32 synchronously with the machine. A rotatable, circular, planar projection 34 is horizontally fixed in the front, center of the machine 14. A horizontal suppressive disc 20 knurled on the periphery thereof is disposed adjacently to the circumference of the projection 34 (see FIG. 9). The suppressive disc 36 is rotatably held by an arm 38 extending from the front, upper side of the machine forward and downward. As shown in FIG. 10, a curved plane pressing member 37 is fixed near and above the projection 34, and extends from the right hand side of the projection 34 toward the front of the table 12 to come into contact with the side edge of a raw tape 2 (see FIG. 11). The projection 34 and the suppressive disc 36 are rotated intermittently in the direction shown by the arrows in FIG. 10. The pressing member 37 takes a position where the upper end of the disk 37 is about 0.2 mm higher than the side edge of the raw tape 2 as shown in FIG. 11.

In the machine 14, a machine needle 40 is horizontally positioned adjacently to the top face of the projection 34, and is so reciprocated in the horizontal direction that the tip of the needle 40 reaches a position above the suppressive disc 36, as shown by a line 40*a* in FIG. 10. In the reciprocation, the machine needle 40 passes under the end of the pressing member 37, as shown at a position 40*b* in FIG. 11. On the other hand, a looper 42 is a claw member which projects horizontally from the lower end of a vertical bar 44.

The vertical bar 44 is secured to a swing bar 46 which projects from the front, upper side of the machine 14 forward horizontally. As shown by the alternate long and short dash lines in FIG. 9, the looper 42 lowers to a position 42*a* behind the pinhole of the needle immediately after the machine needle 40, which has moved forward, begins to withdraw. With withdrawal of the needle 40, the looper 42 rises. When the needle 40 moves backward to a backward limitation, the looper 42 lowers to a position 42*b* in front of the tip of the needle. A bobbin winder stand 48 for a sewing thread 7 is disposed in the back, center of the table 12 (FIG. 7), on the back side of the machine 14. The bobbin winder stand 48 contains at least one pair of a bobbin pin 50 and a bobbin winder pin washer 50. A thread guide bar 54 is horizontally disposed on the upper side. The sewing thread 7 to be passed through the machine needle 40 is delivered from the bobbin of the bobbin winder stand 48, through the thread guide bar 54 and a tension bracket 56 mounted to the top of the machine 14 and then being supplied to the needle 40.

Figure 8:
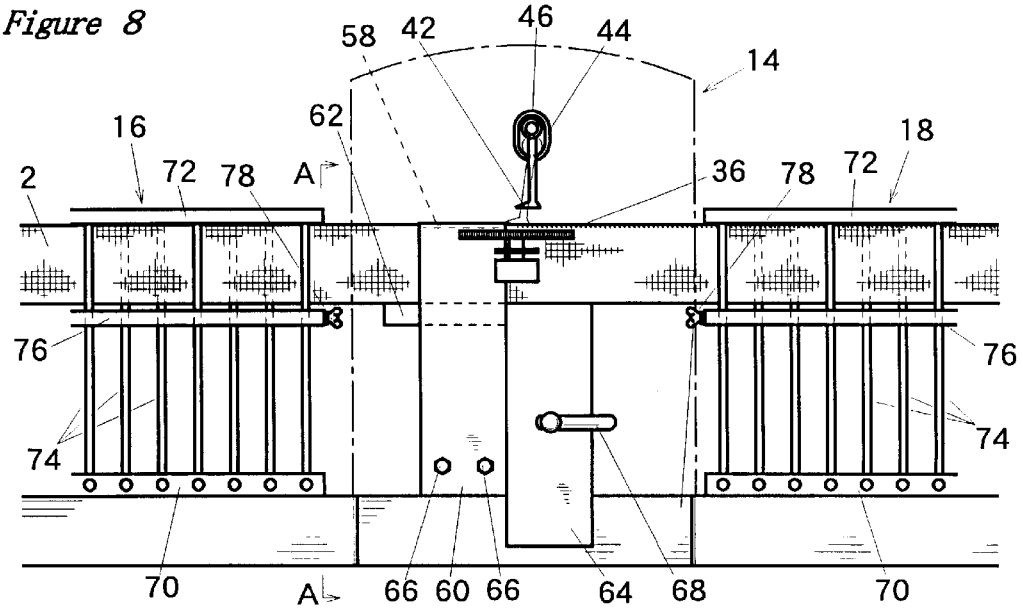
FIG. 8 is a partially enlarged front view of the machine of the apparatus shown in an enlarged machine portion of FIG. 7.
Figure 9:
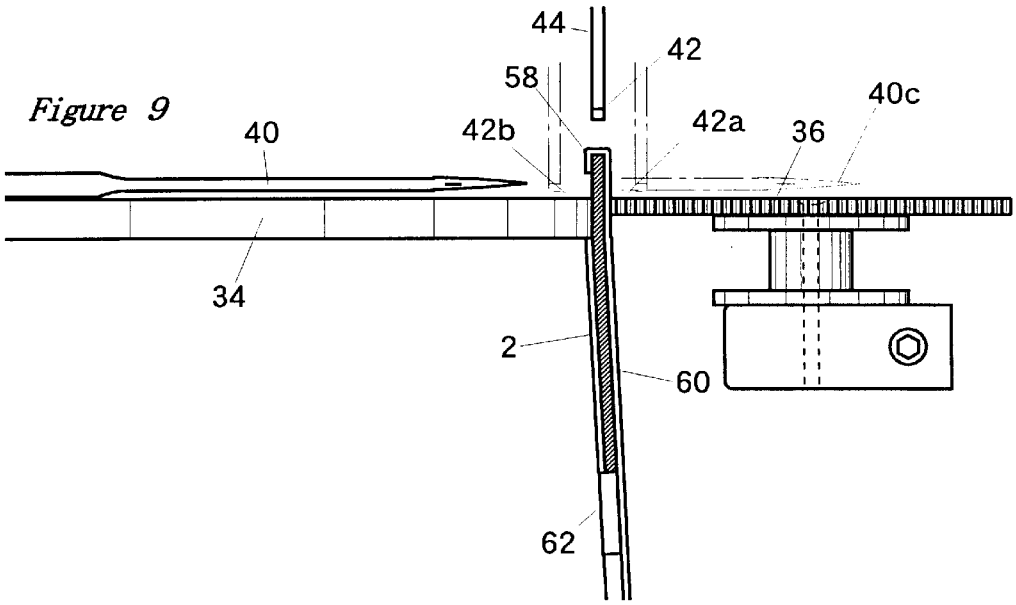
FIG. 9 is a partially enlarged side section taken on line A—A in FIG. 8, in which a pressing disk and so forth are omitted.

In the front of the machine 14, as shown in FIGS. 8, 9, there are attached a first guide plate 60 having a U-sectional portion 58 to receive and support the upper side edge of the raw tape 2, and a second guide plate 64 having a horizontal portion 62 to get into contact with the lower side edge of the raw tape. These plates are disposed substantially vertically and adjacently to each other. The first guide plate 60 is so installed that the U-sectional portion 58 is horizontally arranged in the tangential direction of the projection 34 and the suppressive disc 36, immediately on the left side thereof (see FIG. 10). By loosing nuts 66, 66, the positions of the first guide plate 60 can be vertically adjusted. The second guide plate 64 is at a lower position than the suppressive disk 36, and vertical adjustment of its position is possible with a clamp 68. The vertical distance between the uppermost face in the inner periphery of the U-sectional portion 58 of the first guide plate 60 and the top face of the horizontal portion 62 of the second guide plate 64 corresponds to the breadth of the woven raw tape 2 which is run horizontally in the posture that its transverse direction is kept perpendicular.

The first guide 16 and the second guide 18 as shown in FIG. 8 are arranged substantially in alignment with the guide plates 60, 64, in the opposite direction, in the front of the machine 14. The guides 16, 18 each contains a number of guide bars 74 disposed vertically in parallel, and is attached between a support plate 70 and a horizontal sheet 72. Between the support plate 70 and the horizontal plate 72, a guide plate 76 is fixed which has through-holes which the guide bars 74 are fitted into and out thereof, respectively. The guide plate 76 can be secured at a desired horizontal position by tightening with thumbscrews 78 screwed through the opposite end faces of the guide plate 76, in dependence on the running raw tape 2. The raw tape 2 is horizontally fed between and along the horizontal plate 72 and the guide plate 76, while it is turned toward the right and the left, alternately, contacting with the guide bars 74.

Figure 12:
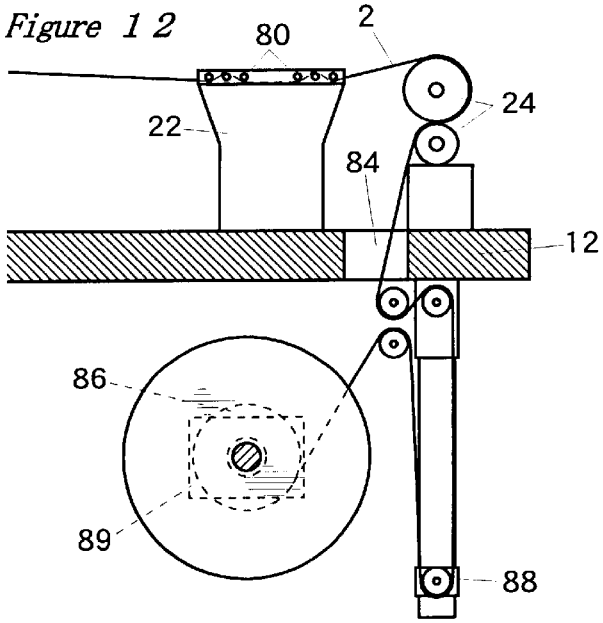
FIG. 12 is a schematic side section of a tape winding portion of the apparatus of FIG. 7.

The horizontal guide 22 is disposed in the back of the table 12, on the back side of the second guide 18. The height of the top of the horizontal guide 22 can be adjusted to be substantially on the same level as the middle between the horizontal plate 72 and the guide plate 76 of the guide 18. The horizontal guide 18 is provided with a number of guide bars 80 between the right, left end positions on the top thereof horizontally, in parallel to each other. The raw tape 2, after it is chain stitched on one side edge, is delivered from the second guide 18. Then, the raw tape 2 takes a posture that its transverse direction is changed to be perpendicular from its horizontal direction. The raw tape 2 is fed through the guide bars 80 while it is turned upward and downward, alternately about the guide bars 80. A pair of the rollers 24, 24 vertically arranged as shown in FIG. 12 are rotatably mounted on the back side of the horizontal guide 22. A pair of the rollers 24, 24 are rotated intermittently synchronously with the machine 14. The pressing force of the rollers 24, 24 can be adjusted by pressing the upper roller against the roller with bolts 82 disposed on the left, right sides of the rollers. An aperture 84 (FIG. 12) is formed in the table 12 substantially beneath the rollers 24. The raw tape 2, while it is withdrawn by the rollers 24, 24, is fed through the aperture 84 to be under the table, and through plural rollers, wound around a spool 86. More particularly, the raw tape 2 is fed from the rollers 24, 24 and wound around the spool 86 through a roller 88 vertically movable. When the roller 88 reaches a lowermost position, the limit switch (not shown) is closed to rotate the spool 86 with a motor 89. On the other hand, when the roller 88 reaches a uppermost position, the other limit switch is opened to stop the rotation of the motor 89. A pair of the rollers 24, 24 may be metallic rollers capable of heating to hot press the raw tape after the chain stitching. In order to prevent the surface of the raw tape 2 from glazing, the surface of the rollers 24, 24 are knurled or is covered with a cylindrical cloth.

Figure 15:
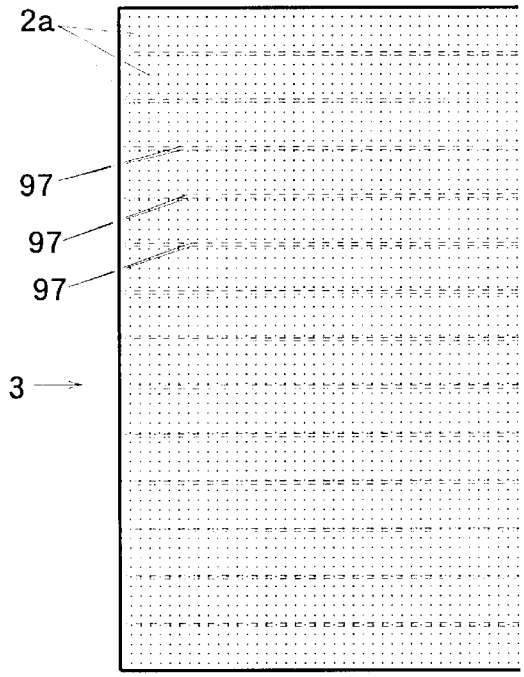
FIG. 15 is a partial plan view exemplifying a wide figured cloth for obtaining the woven tape of FIG. 2 or 2.
Figure 16:
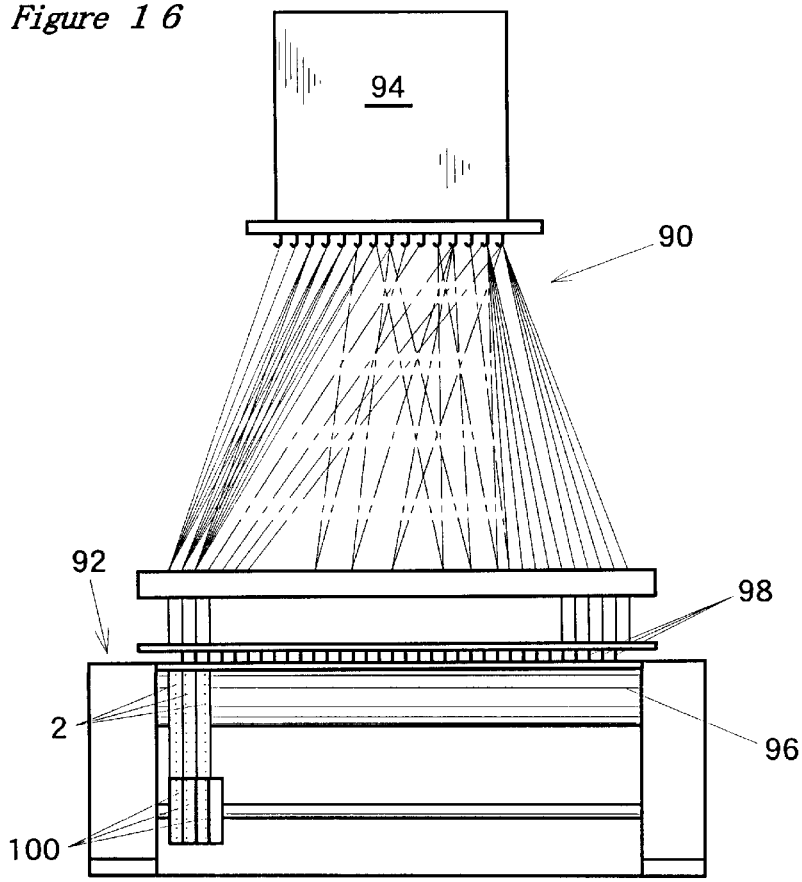
FIG. 16 is a schematic front view of a loom with a jacquard machine for used in weaving of a wide figured cloth.

As publicly known, many pieces of the raw tape 2 are simultaneously formed by using a wide figured woven fabric 3 (FIG. 15). For the weaving of the wide figured woven fabric 3, a figured-weaving mechanism 90 (FIG. 16) is used. The broad loom 90 includes, in combination, a broad loom 92 such as a high speed Rapier loom, a projectile loom, an air jet loom, and so forth, and a jacquard machine 94 which carries out the shedding motion of warp yarns when a wide figured cloth is woven. As the weave of the wide figured cloth 3, a plain weave, a twill weave, a satin weave, and so forth are available. With the broad loom 92 combined with the jacquard machine 94, a complicate pattern can be woven in conformation with the pattern of a card. Thus, a wide figured woven cloth 3 is woven, which is provided with letter patterns 96 (FIG. 3) or picture patterns arranged in a strip-shape in woven tape portions 2*a*. The wide figured woven cloth 3 has a breadth of 70 to 260 cm, and is cut with a cutter installed in the front of or in the back of a breast beam 96 of the broad loom 92. For instance, the wide figured woven cloth 3 is heat-cut along guide yarns 97, 97 to form strips. The cutter, for instance, includes many knives 98 arranged in parallel at predetermined intervals. Each knife 98 is heated to a higher temperature than the melting point of the polyester fibers, for instance, to about 280° C. The many raw tapes 2 formed by heat-cut have linear fiber-molten parts (not shown) formed on the opposite side edges, and taken up around spools 100 in the broad loom 92, respectively.

The spool 100 wound with the raw tape 2 is placed on the spool pin washer of the tape spool stand 20 in the side sewing assembly 10 as shown in FIG. 7. The raw tape 2 is reeled off from the spool, and horizontally fed to the first guide 16. The first guide 16 makes the raw tape 2 take a posture that its transverse direction is perpendicular and supply the raw tape to the side sewing machine 14. The raw tape 2 is accurately positioned by and between the U-sectional portion 58 of the first guide plate 60 and the horizontal portion 62 of the second guide plate 64, and intermittently fed in the direction shown by the arrow in FIG. 7, by the projection 34 and the suppressive disc 36. The chain stitch width h of the raw tape 2 ranges from a needle position 40*b* to the upper edge of the raw tape 2 as shown in FIG. 11. The chain stitch width h can be controlled with the position of the raw tape 2 adjusted appropriately vertically.

Referring to FIG. 11, when the machine needle 40 moves forward and penetrates the raw tape 2 in its stop state, at a point 102 for instance, a sewing thread 7 passing through the pinhole of the needle 40 goes through the raw tape from the back to the front side thereof, so that a loop 104 is formed on the tape front side. Immediately after the needle 40 moves forward to reach a position 40*c* shown in FIG. 9 and begins to withdraw, a looper 42 lowers to a position 42*a* lying on the back side of the pinhole of the needle 40, in front of the raw tape, and swings to some degree to hook the loop. Then, the needle 40 withdraw to be out of the raw tape 2. Then, the raw tape 2 is intermittently moved a distance d in the direction shown by the arrow in FIG. 11, that is, in the direction shown by the arrow in FIG. 7. The looper 42 rises, hooking the loop 104, simultaneously with withdrawal of the machine needle 40, and is moved back from the tape front side to the tape back side. The needle 4, when it reaches a position on the tape back side, begins to lower. When the machine needle 40 moves backward to the position where the needle 40 is shown in the continuous line in FIG. 9, the looper 42 hooking the loop 104 lowers to a position 42*b* in front of the tip of the needle 40. In this case, the sewing thread 7 forming the loop 104 gets into direct contact with the top face in the end portion of the pressing member 37, not directly contacting with the side edge of the raw tape 2. When the machine needle 40 moves forward again, the looper 42 swings reversely to be out of the loop 104. The needle 40, on the tape back side, passes through the loop 104 taken out by the looper 42, and pierces the raw tape 2 at a point 102*b*. As a result, the loop 104 of the sewing thread 7 is stitched on the side edge of the tap material 2. When the machine needle 40 moves forward, the looper 42 begins to rise. In the same manner as described above, the succeeding loop 104 is stitched at a position 40*b*. Then, the raw tape 2 is moved a distance d in the right hand direction, the preceding loop 104 is released from the end of the pressing member 37 as shown in FIG. 11, so that the loop 104 gets into the direct contact with the side edge of the raw tape 2. As seen in the above description, the sewing thread 7 of the loop 104 is prevented from contacting directly with the side edge of the raw tape 2 when the sewing thread 7 is strongly stretched for fastening. Accordingly, a chain-stitch 8 can be formed in a stable condition without cutting or fluffing of the sewing thread 7, irrespective of the rigidity, thickness, and so forth of the raw tape 2. Then, the above described operation is repeated to perform the end sewing.

In the raw tape 2 processed with the side-sewing assembly 10, one sewing thread 7 forming the chain stitch 8 crosses the fiber molten part on the side edge of the raw tape 2, and the stitches are continuous without being overlapped. Practically, the sewing thread 7 is stitched closely without gaps, as shown in FIG. 11, formed between the stitches. In case of a thin sewing thread, it covers closely the fiber molten part. Referring to the side-sewing machine 10, the raw tape 2, after one side edge thereof is stitched, is wound around the spool 86 (FIG. 12). The wound raw tape 2 is applied to the assembly 10 again to produce a woven tape 106 of which the both side edges are chain stitched as shown in FIG. 1. The sewing threads 7 present substantially equal inclinations viewed in the plan of the woven tape 106. In case a repeated pattern is formed, the woven tape 106 may be cut as individual labels to obtain woven labels. For a tape of this kind, thin sewing threads 7 are used, and the thread penetration points 102*a*, 102*b*, and so forth are arranged in a linear one row only. Therefore, the chain stitch width h can be easily controlled by vertical adjustment of the position of the raw tape prior to stitching. The appearance of the tape can be prevented from being deteriorated by adjusting the chain stitch width h to be narrow as much as possible. For the woven tape 106, the weft yarn of the raw tape 2 may be used as; the sewing thread 7. In this case, the color and design of the tape 106 can be harmonized as a whole.

Figure 2:
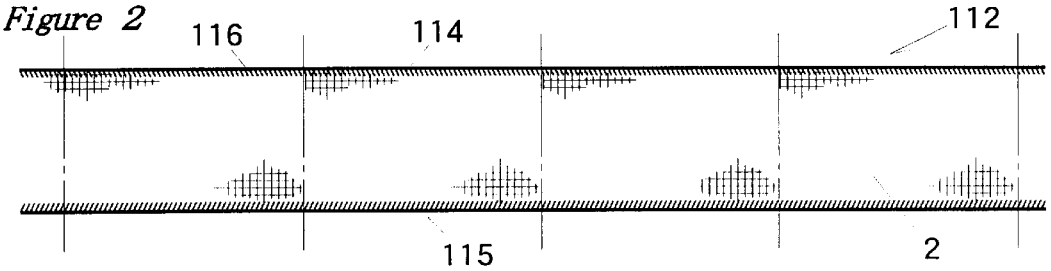
FIG. 2 is a schematic plan view of another woven tape of which the both side edges are sewn in accordance with the present invention.
Figure 3:
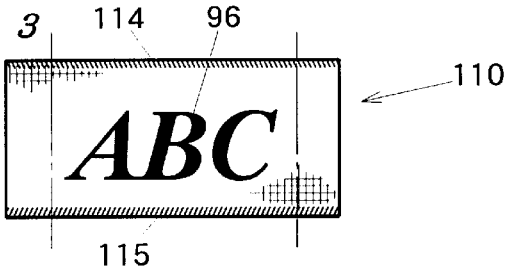
FIG. 3 is a schematic plan view of a side edge sewn label obtained by cut of the woven tape of FIG. 2.
Figure 4:
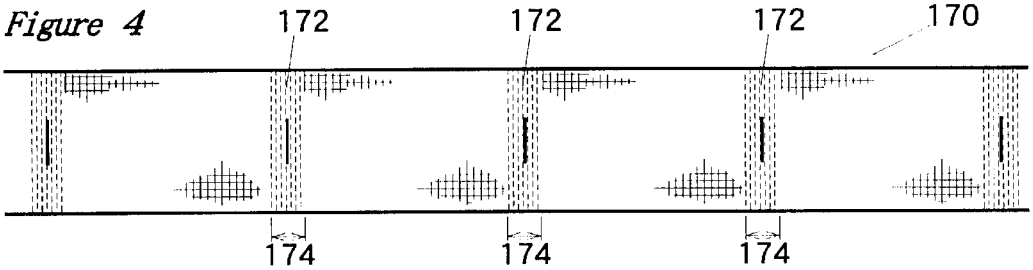
FIG. 4 is a schematic plan view of another woven tape containing heat shrinkable yarns woven in a fold portion in accordance with the present invention.
Figure 13:
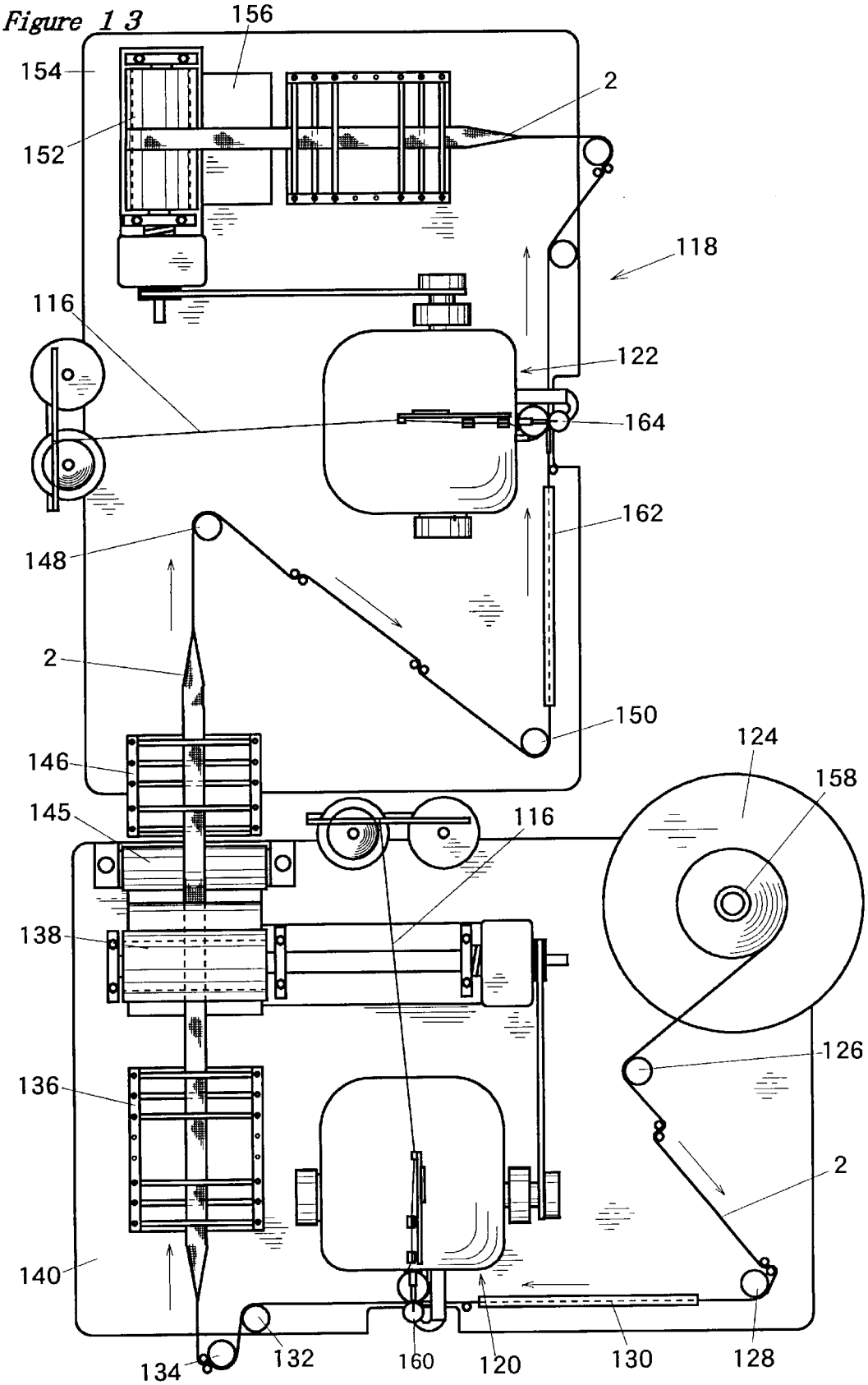
FIG. 13 is a schematic overall plan view of an apparatus for side-stitching the both side edges of a woven tape continuously.

A woven label 110 shown in FIG. 3 is formed with a chain stitched tape 112 (FIG. 2). The inclinations of the sewing threads 116 of the chain stitches 114, 115 on the both sides of the label 110 are substantially center line symmetrical, viewed in the plan. This effectively prevents the label 110 from twisting. In order to form the tape 112, the raw tape 2 is run one time to be processed with a both-side sewing assembly 118 (FIG. 13). One sewing thread 116 forming chain stitches 114, 115 crosses the fiber molten parts on the side edges of the tape 112. The stitches are continuous without being overlapped. Even if the sewing thread 116 is thin, it covers closely the fiber molten parts. The tape 112, if it is provided with a series of patterns, may be used as it is. In order to obtain the woven labels 110 shown in FIG. 3, the tape 112 is heat cut in the transverse direction, every line-position shown by an alternate long and short dash line in FIG. 2. The label 110 is end-held along the line-position shown by an alternate long and short dash line in FIG. 4, in the succeeding folding process.

The both side sewing assembly 118 for production of the tape 112 has such a structure that two assemblies each as shown as the assembly 10 in FIG. 7 are combined. With respect to a first machine 120, the raw tape 2 is fed in the direction shown by an arrow in FIG. 13, that is, in the left-hand direction, which is opposite to the tape feeding direction of the machine 14 (FIG. 7). With respect to a second machine 122, the raw tape 2 is fed in the direction shown by an arrow in FIG. 13. This direction is the same as the tape feeding direction of the machine 14 (FIG. 7). To the first machine 120, the raw tape 2 delivered from a tape spool stand 124 is fed through vertical rollers 126, 128 and a guide 130. The guide 136 has the same structure as the guide 16 (FIG. 8). The raw tape 2 leaving the machine 120 is run through vertical rollers 132, 134, a horizontal guide 136, and a pair of upper, lower rollers 138. The horizontal guide 136 and the roller 122 have substantially the same structures as the horizontal guide 22 and the roller 24 (FIG. 7). In addition, the second machine 122 has the same structure as the machine 14 (FIG. 7).

Figure 14:
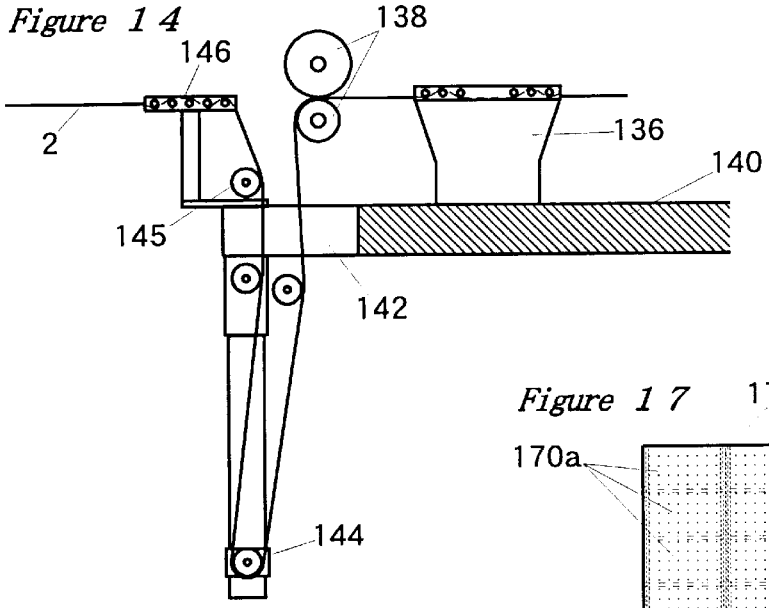
FIG. 14 is a schematic partial side section of the apparatus of FIG. 13, illustrating a portion where a woven tape is delivered from one machine side to the other machine side.

As shown in FIG. 14, an aperture 142 is provided in a table 140 under a pair of the rollers 138, 138 installed on the machine 120 side. The raw tape 2 is pulled by a pair of the rollers 138, 138, fed to be under the table 140, and from a pair of the rollers 138, 138, applied around a roller 144 movable vertically to be turned. The raw tape 2 is further fed through a horizontal roller 145 at an upper position and a horizontal guide 146, toward vertical rollers 148, 150. A difference between the feeding velocities of the machines 120, 122 can be reduced by vertical movement of the roller 144. With respect to the machine 122, an aperture 156 is provided in a table 154 near and under a pair of withdrawing rollers 152. The raw tape is withdrawn by a pair of the rollers 152, fed to be under the table 154, and further fed through a roller (not shown) vertically movable to be wound around a spool.

With respect to the both side sewing assembly 118, a spool 158 wound with the raw tape 2 is placed on a spool pin washer of a tape spool stand 124. The raw tape 2 is reeled off from the spool, and horizontally fed through a guide 130.

The raw tape 2, kept upright on the side thereof and directed in the longitudinal direction by the guide, and supplied to the machine 120. The raw tape 2 accurately positioned is intermittently fed toward the right hand side by a suppressive disk 160, and simultaneously a chain stitch 115 (FIG. 2) is formed. The raw tape 2 of which one side edge is stitched is horizontally withdrawn through a guide 136 and rollers 138, 138, passed through the rollers 144, 145, and horizontally fed over the guide 146. The raw tape is made to take a posture that its transverse direction is vertical by the vertical roller 148, when the chain stitch 115 (FIG. 4) is positioned on the lower side. The raw tape 2 is supplied through the guide 162 to the machine 122, where the raw tape 2 is intermittently fed to the right-hand side with the suppressive disk 164, forming the other chain stitch 114 (FIG. 2). The tape 112 of which both side edges are sewn are withdrawn by the rollers 152, 152, and wound around the spool under the table 154.

Figure 6:
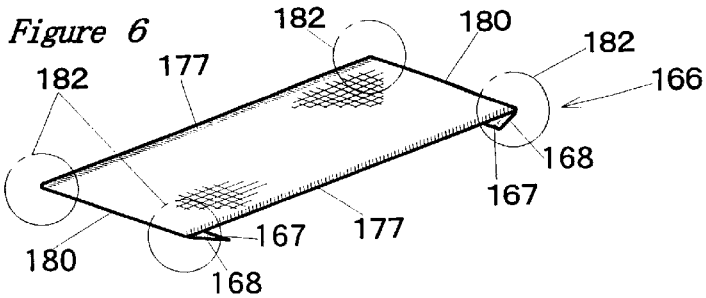
FIG. 6 is a perspective view of a side edge sewn label obtained by cutting and end-holding of the woven tape of FIG. 5.

An another woven label shown in FIG. 6 has a slight depression in the both-side edges 168 of a fold 167 thereof. In a raw tape 170 which is cut to form woven labels 166, heat shrinkable yarns as weft yarns are partially woven. The shrinkable yarns may be woven widely in a portion 174 corresponding to a fold 167 or three to five heat shrinkable yarns may be woven in each portion of the raw tape 170 corresponding to a bending portion of the woven label 166. As the shrinkable yarns 172, polyester high shrinkable yarns (manufactured by Toray Industries Inc.) which are white and heat shrinkable at about 140° C., nylon yarns, rayon yarns shrinkable with water, and so forth are exemplified. The woven label 166 is partially shrunk by a predetermined shrinking method. In general, the width of the depression is preferably 0.1–0.4 mm, depending of the types of raw materials and the size of the label.

Figure 5:
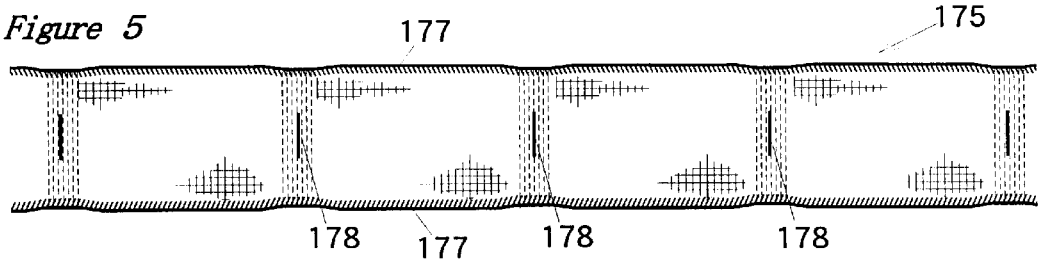
FIG. 5 is a schematic plan view of a woven tape obtained by shrink-finishing of the woven tape of FIG. 4.
Figure 17:
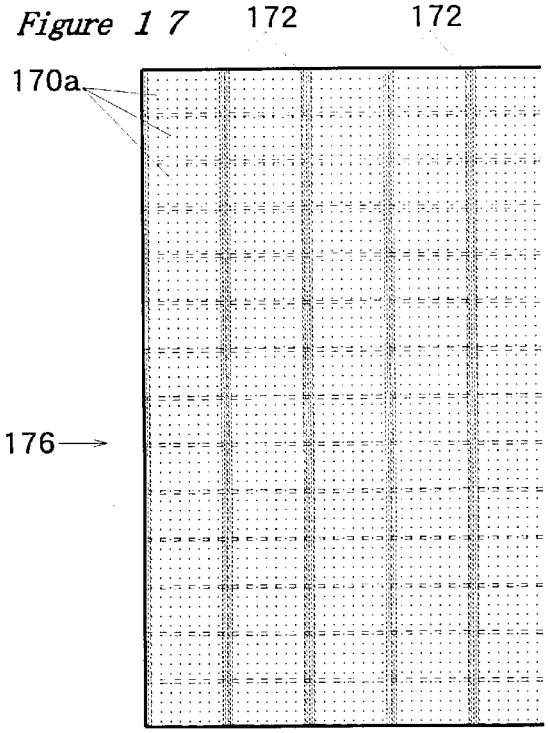
FIG. 17 is a partial plan view of a wide figured cloth adapted to form the woven tape of FIG. 4.

The label material 175 (FIG. 5) is produced by using the raw tape 170 as described below. When a wide figured cloth 176 (FIG. 17) is woven with synthetic yarns as warps and wefts, shrinkable yarns 172 as wefts are woven partially into portions of the cloth corresponding to folds of the tape to be provided at label intervals prior to sewing. Then, the wide figured cloth 176 is heat cut every tape portion 170*a* into strips. The obtained raw tape 170 (FIG. 4) is supplied to the both-side sewing machine 118 by which the both side edges of the raw tape 170 are chain stitched to form the chain stitches 177, 177. Then, the raw tape 170 of which the both side edges are sewn is heated at about 140° C. and pressed, so that the both side edges of the fold 167 is depressed in a depth of about 0.3 mm. The label material 175 is resin-finished with a chemical paste for finishing of the shape, if necessary. After resin-finishing, the raw tape 175 is heat cut with an another heat cut device (not shown) every label intervals in the transverse direction. Each cut position is shown by a mark 178. The obtained woven label 166 is end-held and pressed in the succeeding folding process.

The woven label 166 has a depression on the both side edges in the fold 167 by which the fiber molten parts are bent downward, preventing the formation of projecting pieces formed with the fiber molten parts in the both side corners 182 inside of a fold line 180 as shown in FIG. 6. In addition, the fold 167 becomes rather narrow, so that the fold turned to the back side is prevented from exposing from the edge of the label body. This is preferable form the viewpoint of good appearance.

A side sewing tape of the present invention of which the fiber molten part is not exposed has a good feeling to the touch. The fiber molten parts in the both side corners of a fold portion are prevented from projecting in a piece shape. In the case that a sewing thread used in the side sewing tape is a weft yarn of the raw tape, the color and design of the tape as a whole is harmonious and preferable from the viewpoint of good appearance. The tape, in case it is cut and sewn as a label on an underwear garment, solves the problems that the fiber molten parts on the both side edges of the label can injure a wearer's skin or cause a rash. In case the label is sewn on an outer garment such as a ski wear and so forth, no loose or fluffing of a sweater worn under and an intermediate shirt occurs. The both side edge sewing portions of the label are prevented from being upheaved, and the thickness has substantially no irregularities. This is in favor of the storage and sewing of the label.

In addition, the both side edges of a fold of the woven label can be slightly depressed by partial weaving of shrinkable yarns. When the label is end-held or center-held, the fold on the back of the label becomes narrow in the width direction. Thus, a fold of the label, when it is turned to the back of the label, is prevented from being exposed from the edges of the label outward. Accordingly, any protrusion of the fiber molten parts is completely eliminated.

According to a method of the present invention, the both side edges of a woven tape are closely edge-sewn prior to cutting and folding of a label. The side edge sewing of the woven tape is automatically carried out. Thus, increase in the manufacturing cost of the woven tape is prevented, contributed by the labor saving. In case shrinkable yarns are woven partially in a wide figured cloth, the side weaving label can be efficiently produced by using the wide figured cloth.

What is claimed is:

1. A woven tape having fiber molten parts which are generated on both sides thereof by cutting a wide figured cloth using heat in the cutting, which comprises a tape body and two lines of chain stitch extending along both side edges thereof, each line of the chain stitch comprising a succession of loops formed with one sewing thread penetrating from one side to an opposite side of the tape and crossing over an associated side edge of the tape repeatedly so that the loops of the sewing thread are closely arranged side by side, whereby the fiber molten parts are covered with the sewing thread chain stitch.

2. The woven tape according to claim 1, wherein an inclination of a loop of the chain stitch on each side edge of the woven tape is substantially symmetric with respect to the center line on the plane of the woven tape.

3. A woven label which has been cut from the chain stitched woven tape body of claim 2 at each of two successive transverse line positions on said tape body.

4. The woven label according to claim 3, wherein a pair of depressions is formed at equal distances on each of opposite side edges of said label to mark where the label is folded incident attaching it to clothes by interweaving shrinkable yarns partially as weft yarns when weaving the wide figured cloth.

5. A woven label which has been cut from the chain stitch woven tape body of claim 1 at each of two successive transverse line positions on said woven tape body.

6. The woven label according to claim 5, wherein a pair of depressions is formed at equal distances on each of opposite side edges of said label to mark where the label is folded incident attaching it to clothes by interweaving yarns partially as weft yarns when weaving the wide figured cloth.

7. A method for side-stitching a raw tape having fiber molten parts on both side edges thereof, which comprises:

providing that a transverse width of the raw tape is kept disposed vertically;

delivering the raw tape to a machine having a horizontally operated needle and a looper that oscillates back and forth for forming a thread loop; and chainstitching at least one side edge of the raw tape with a sewing thread, to form a succession of closely spaced chain stitches along said side edge.

8. The method according to claim 7, wherein a loop of the sewing thread comes in contact with an upper face of an end of a pressing member, keeping the loop apart from the side edge of the raw tape, when the looper hooking a loop is driven through vertical and oscillating motions to a position in front of a tip of the needle, whereby the side edge of the woven tape is free from a high tension to the sewing thread when fastening the loop and thus the shape of the chain stitch is held constant regardless of rigidity and thickness of the woven tape.

9. The method according to claim 7, wherein the feeding raw tape is positioned by a first guide plate which supports an upper side edge of the raw tape and a second guide plate which contacts with a lower side edge of the raw tape, the first and second plates are vertically adjustable in position, and a vertical distance between the uppermost face in a U-sectional inside surface of the first plate and a top face in a horizontal position of the second plate corresponds to a width of the raw tape.

10. The method according to claim 7, which comprises:

interweaving at least one shrinkable yarn as weft yarns partially in positions where a label is folded to attach on clothes when weaving a wide figured cloth;

cutting the wide figured cloth into strip using heating in the cutting;

chainstitching the side edge of the raw tape in a longitudinal direction thereof; and shrinking partially the stitched tape by a treatment selected from the group consisting of heat, immersion and spray treatments, whereby a pair of depressions is formed at equal distances on both side edges of the stitched tape.

11. A method for side-stitching a raw tape having fiber molten parts on both side edges thereto, which comprises;

providing that a transverse width of the raw tape is kept disposed vertically;

delivering the raw tape to a machine having a horizontally operated needle and a looper that oscillates back and forth for forming a thread loop;

chainstitching one side edge of the raw tape with a sewing thread, to form a succession of closely spaced chain stitches along said one side edge;

turning the raw tape upside down;

delivering the raw tape to another machine having a horizontally operated needle and a looper that oscillates back and forth for forming a thread loop; and chainstitching an opposite side edge of the raw tape with a sewing thread to form a succession of chain stitches along said opposite side edge.

12. The method according to claim 11, wherein a loop of the sewing thread comes in contact with an upper face of an end of a pressing member, keeping the loop apart from a side edge of the raw tape, when the looper hooking the loop is driven through vertical and oscillating motions to a position in front of a tip of the needle, whereby the side edge of the woven tape is free from a high tension to the sewing thread when fastening the loop and thus the shape of the chain stitch is held constant regardless of rigidity and thickness of the woven tape.

13. The method according to claim 11, wherein the feeding raw tape is positioned by a first guide plate which supports an upper side edge of the raw tape and a second guide plate which contacts with a lower side edge of the raw tape, the first and second plates are vertically adjustable in position, and a vertical distance between the uppermost face in a U-sectional inside surface of the first plate and a top face in a horizontal portion of the second plate corresponds to a width of the raw tape.

14. The method according to claim 11, which comprises:

interweaving at least one shrinkable yarn as weft yarns partially in positions where a label is folded to attach on clothes when weaving the wide figured cloth;

cutting the wide figured cloth into a strip using heating during the cutting;

chainstitching the side edge of the raw tape in a longitudinal direction thereof; and shrinking partially the stitched tape by a treatment selected from the group consisting of heat, immersion, and spray treatment, whereby a pair of depressions is formed at equal distances on both side edges of the stitched tape.

* * * * *